US006754993B1

(12) United States Patent
Mayle et al.

(10) Patent No.: US 6,754,993 B1
(45) Date of Patent: Jun. 29, 2004

(54) ADJUSTABLE CORNER ROOF MEMBRANE AND METHOD OF MAKING THE SAME

(76) Inventors: Steven R. Mayle, 2274 Augusta Dr., Fremont, OH (US) 43420; Robert L. Mayle, 2047 Hyde Rd., Port Clinton, OH (US) 43452

( * ) Notice: Subject to any disclaimer, the term of this patent is extended or adjusted under 35 U.S.C. 154(b) by 0 days.

(21) Appl. No.: 10/125,768

(22) Filed: Apr. 18, 2002

(51) Int. Cl.[7] ..... E04D 1/36; E04D 13/14; E04D 3/38

(52) U.S. Cl. ..... 52/58; 52/60; 52/61; 52/287.1; 52/631

(58) Field of Search ..... 52/58, 60, 61, 52/287.1, 631

(56) References Cited

U.S. PATENT DOCUMENTS

| | | | | |
|---|---|---|---|---|
| 322,153 | A | 7/1885 | Blair et al. | 52/746.11 X |
| 549,352 | A | 11/1895 | Folger | 285/43 |
| 821,426 | A | 5/1906 | Meyer | 24/280 |
| 835,889 | A | 11/1906 | Moeller | 52/521 |
| 1,012,219 | A | 12/1911 | Overton | 285/42 |
| 1,031,577 | A | 7/1912 | Overton | 285/42 |
| 1,080,159 | A | 12/1913 | Overton | 285/42 |
| 1,103,666 | A | 7/1914 | Fife | 285/42 |
| 1,163,034 | A | 12/1915 | Phippen | 52/551 |
| 1,195,338 | A | 8/1916 | Churchill | 285/44 |
| 1,202,687 | A | 10/1916 | Elkerton | 285/13 |
| 1,540,192 | A | 6/1925 | Smith | 285/13 |
| 1,594,932 | A | 8/1926 | Doyle | 285/42 |
| 1,678,715 | A | 7/1928 | Stephenson | 285/42 |
| 1,721,715 | A | 7/1929 | Schindler | 285/42 |

(List continued on next page.)

FOREIGN PATENT DOCUMENTS

| | | |
|---|---|---|
| CH | 221530 | 6/1942 |
| DE | 3321101 | 12/1983 |
| GB | 1 310 003 | 1/1971 |
| GB | 1 355 517 | 5/1971 |
| GB | 1 511 729 | 10/1975 |
| JP | 49-002675 | 1/1974 |

OTHER PUBLICATIONS

GenFlex Product Details for Field Fabricated Outside Corner.

Technical product literature from Duro–Last, Inc., Jan. 1, 1993, 1 page.

Technical product literature from Duro–Last, Inc., Jan. 1, 1993, 1 page.

Alkor Single Ply Roofing Systems brochure.

At Last Roofing, Inc., 1986.

Benoit E.P.D.M. Roofing Systems brochure, 1983.

Bond Cote Roofing Systems detail drawings, Jul. 1988, 7–5.1, 7–6, 7–6.1, 7–9.

(List continued on next page.)

*Primary Examiner*—Carl D. Friedman
*Assistant Examiner*—Nahid Amiri
(74) *Attorney, Agent, or Firm*—Standley Law Group LLP

(57) ABSTRACT

An adjustable corner fitment for a roof and a method and apparatus for making the same are provided. The adjustable corner fitment may be comprised of a top membrane portion and a base membrane portion. The top membrane portion may have a cutout that may extend from a side of the top membrane portion. The base membrane portion may have four sides. The first side of the base membrane portion is preferably connected to the second side of the base membrane portion at a first angle greater than 90 degrees, and the third side of the base membrane portion is preferably connected to the fourth side of the base membrane portion at a second angle greater than 90 degrees. It is preferred that the top membrane portion and the base membrane portion are made from thermoplastic olefin (TPO) material or polyvinyl chloride (PVC) material.

40 Claims, 10 Drawing Sheets

U.S. PATENT DOCUMENTS

| | | | | |
|---|---|---|---|---|
| 1,923,220 | A | 8/1933 | Lightbown | 285/13 |
| 2,069,289 | A | 2/1937 | Swendsen et al. | 52/288.1 |
| 2,151,794 | A | 3/1939 | Peebles | 52/553 X |
| 2,176,344 | A | 10/1939 | Hunt | 52/551 |
| 2,256,313 | A | 9/1941 | Dexter | 52/551 |
| 3,040,154 | A | 6/1962 | Marsh | 156/539 |
| 3,054,222 | A | 9/1962 | Buckner | 52/543 |
| 3,325,953 | A | 6/1967 | Alleaume | 52/276 |
| 3,446,685 | A | 5/1969 | Goldstone et al. | 156/219 |
| 3,446,688 | A | 5/1969 | Flax | 156/423 |
| 3,451,178 | A | 6/1969 | Beale | 52/210 |
| 3,566,562 | A | 3/1971 | White | 52/748.1 X |
| 3,763,605 | A | 10/1973 | Freeman | 52/58 |
| 3,871,145 | A | 3/1975 | Hatmaker | 285/42 |
| 3,887,323 | A | 6/1975 | Bratten | 425/521 |
| 3,890,754 | A | 6/1975 | Spurdle | 52/631 |
| 3,894,376 | A | 7/1975 | Shearer | 52/518 |
| 3,942,295 | A | 3/1976 | Schacht | 52/288 |
| 4,049,034 | A | 9/1977 | Vcelka et al. | 150/8 |
| 4,112,632 | A | 9/1978 | Simpson | 52/11 |
| 4,115,961 | A | 9/1978 | Bishop | 52/58 |
| 4,120,129 | A | 10/1978 | Nagler et al. | 52/219 |
| 4,162,597 | A | 7/1979 | Kelly | 52/410 |
| 4,192,116 | A | 3/1980 | Kelly | 52/469 |
| 4,217,742 | A | 8/1980 | Evans | 52/553 |
| 4,223,486 | A | 9/1980 | Kelly | 52/1 |
| 4,226,069 | A | 10/1980 | Hinds | 52/521 |
| 4,265,058 | A | 5/1981 | Logsdon | 52/58 |
| 4,302,275 | A | 11/1981 | Burmeister et al. | 156/446 |
| 4,335,546 | A | 6/1982 | Kelly | 52/58 |
| 4,351,140 | A | 9/1982 | Simpson | 52/542 |
| 4,374,695 | A | 2/1983 | Ikeda et al. | 156/293 |
| 4,382,353 | A | 5/1983 | Kelly | 52/506 |
| 4,386,488 | A | 6/1983 | Gibbs | 52/199 |
| 4,389,826 | A | 6/1983 | Kelly | 52/410 |
| 4,419,067 | A | 12/1983 | Graafmann | 425/392 |
| 4,441,295 | A | 4/1984 | Kelly | 52/408 |
| 4,446,665 | A | 5/1984 | Berger | 52/407 |
| 4,449,336 | A | 5/1984 | Kelly | 52/105 |
| 4,493,175 | A | 1/1985 | Coppola, Jr. | 52/410 |
| 4,496,410 | A | 1/1985 | Davis et al. | 156/84 |
| 4,544,593 | A | 10/1985 | Borgert et al. | 428/80 |
| 4,555,296 | A | 11/1985 | Burtch et al. | 156/446 |
| 4,557,081 | A | 12/1985 | Kelly | 52/94 |
| 4,603,517 | A | 8/1986 | Lyons, Jr. | 52/60 |
| 4,625,469 | A | 12/1986 | Gentry et al. | 52/3 |
| 4,635,409 | A | 1/1987 | Vandemore | 52/60 |
| 4,642,950 | A | 2/1987 | Kelly | 52/90 |
| 4,652,321 | A | 3/1987 | Greko | 156/165 |
| 4,668,315 | A | 5/1987 | Brady et al. | 156/71 |
| 4,671,036 | A | 6/1987 | Sullivan | 52/518 |
| 4,688,361 | A | 8/1987 | Kelly | 52/173 R |
| 4,700,512 | A | 10/1987 | Laska | 52/58 |
| 4,712,348 | A | 12/1987 | Triplett et al. | 52/408 |
| 4,718,211 | A | 1/1988 | Russell et al. | 52/409 |
| 4,726,164 | A | 2/1988 | Reinwall et al. | 52/410 |
| 4,736,562 | A | 4/1988 | Kelly | 52/173 R |
| 4,799,986 | A | 1/1989 | Janni | 156/196 |
| 4,834,828 | A | 5/1989 | Murphy | 156/359 |
| 4,848,045 | A | 7/1989 | Nichols et al. | 52/60 |
| 4,860,514 | A | 8/1989 | Kelly | 52/410 |
| 4,870,796 | A | 10/1989 | Hart et al. | 52/409 |
| 4,872,296 | A | 10/1989 | Janni | 52/58 |
| 4,888,930 | A | 12/1989 | Kelly | 52/410 |
| 4,909,135 | A | 3/1990 | Greko | 98/42.23 |
| 4,947,614 | A | 8/1990 | Mayle | 52/717.1 |
| 4,963,219 | A | 10/1990 | Nichols et al. | 156/304.2 |
| 5,014,486 | A | 5/1991 | Mayle | 52/717.1 |
| 5,027,572 | A | 7/1991 | Purcell et al. | 52/309.9 |
| 5,031,374 | A | 7/1991 | Batch et al. | 52/58 X |
| 5,065,553 | A | 11/1991 | Magid | 52/58 |
| 5,077,943 | A | 1/1992 | McGady | 52/58 |
| 5,145,617 | A | 9/1992 | Hermanson et al. | 264/143 |
| 5,197,252 | A | 3/1993 | Tiscareno | 52/553 |
| 5,218,793 | A | 6/1993 | Ball | 52/62 |
| 5,365,709 | A | 11/1994 | Lassiter | 52/408 |
| 5,452,553 | A | 9/1995 | Clapp et al. | 52/408 |
| 5,570,553 | A | 11/1996 | Balkins | 52/748.1 X |
| 5,586,414 | A | 12/1996 | Tawzer | 52/96 X |
| 5,605,019 | A | 2/1997 | Maziekien et al. | 52/58 |
| 5,706,610 | A | 1/1998 | Mayle | 52/58 |
| 5,740,647 | A | 4/1998 | Kelly | 52/408 |
| 5,775,052 | A | 7/1998 | Mayle | 52/746.11 |
| 5,829,214 | A | 11/1998 | Hart | 52/302.6 |
| 5,850,719 | A | 12/1998 | Mayle | 52/408 |
| 5,930,969 | A | 8/1999 | Mayle et al. | 52/545 |
| 5,935,357 | A | 8/1999 | Hubbard et al. | 156/82 |
| 5,983,592 | A | 11/1999 | Mayle | 52/746.11 |
| 6,004,645 | A | 12/1999 | Hubbard | 428/57 |
| 6,021,616 | A | 2/2000 | Mayle | 52/408 |
| 6,110,311 | A | 8/2000 | Mayle et al. | 156/189 |
| 6,187,122 | B1 | 2/2001 | Hubbard et al. | 156/82 |
| 6,199,326 | B1 | 3/2001 | Mayle | 52/58 |
| 6,205,730 | B1 | 3/2001 | Hasan et al. | 52/408 |
| 6,250,034 | B1 | 6/2001 | Hulsey | 52/410 |

OTHER PUBLICATIONS

Custom Seal detail drawings, #1–#41.
Duro–Last detail drawings, Jun. 1983, 7.10, 7.11.
Duro–Last Roofing, Inc. The Complete Roofing System.
Duro–Last Roofing, Inc. Factory Mutual Systems manual, mid–1980's.
Duro–Last Roofing, Inc. information manual, 1991–1994.
Duro–Last Roofing, Inc. information manual.
Duro–Last Roofing, Inc. manual, Jan. 1992.
GAF Roofing Products brochure, 1983.
GenFlex Roofing Systems detail drawings, 1994.
General Tire All Climate Roofing Systems brochure, 1982.
General Tire Building and Products Company, The General Tire and Rubber Company, Field Fabricated Pipe Boot spec sheet, Jun. 1983, F–3.01.
GTR Building and Products Company, The General Tire and Rubber Company, GenSeal ACR Roofing System Roof Pipe Penetration spec sheet.
GTR Building and Products Company, The General Tire and Rubber Company, Prefabricated Pipe Boot spec sheet, Jun. 1984, F–3.03.
I.p.w. Interplastic Interoof Systems brochure.
Johns–Manville Manual for Built–Up Roof Systems brochure, 1983.
J.P. Stevens Hi–Tuff single–ply membrane roofing systems brochure.
Koppers The Roofing People brochure.
Mayle, Steve, Side elevational view of Custom Seal's corner piece, Fig. 7.
Mule–Hide Products Co., Inc. detail drawings, Feb. 1993, MH–112, MH–121.
Owens–Corning Fiberglass PermaPly—R brochure, 1982.
Polyken Roofing Systems brochure.
Rubber and Plastics Company, Inc. Ingle Ply Membrane Roofing brochure.
Sarnafil detail drawings, 1984, 5.1–5.3.
Sarnafil Roofing Membranes brochure.
Seal–Dry/USA, Inc. detail drawings, Jun. 1994.
Seaman Corp. Fiberlite Single Ply Roof field fabricated pipe flashing drawing, Oct. 1986, FTR–D19.

Seaman Corp. Fiberlite Single Ply Roof, pre–formed pipe flashing drawing, Jan. 1996, FTR–DP3.
Siplast brochure.
Tamko Built–Up Roofing Systems brochure, 1983.
Trocal Roofing Systems brochure.
WeatherGuard Single Ply Elastromeric Roofing Systems brochure.

ADJUSTABLE CORNER ROOF MEMBRANE AND METHOD OF MAKING THE SAME

BACKGROUND AND SUMMARY OF THE INVENTION

The present invention relates generally to roof-covering membranes, and more particularly, to an adjustable corner fitment and roof membrane system. Polymer-coated membranes may be used to cover substantially flat roofs. The membrane is preferably custom designed for the particular roof on which it is to be used. The roof measurements may be provided to a factory which may create a unitary membrane from separate pieces which have been heat welded together.

Items such as vents, ductwork, air conditioning units, and the like commonly protrude from the surface of a roof. The size and location of these items is preferably provided to the factory which creates the membrane. With this information, the factory may make provisions for these items in the membrane.

Providing a water-tight seal around a protrusion in a roof presents a number of problems. U.S. Pat. No. 4,872,296 discloses a method and a fitment which have been used to cover the corners of protrusions. The fitment of this patent comprises a first generally rectangular member segment, a side being part-way split interjacent its ends, and a second member segment with a triangularly-shaped corner portion conformed to loop shape and having its marginal edges overlying portions of the first segment contiguous to the split and being welded thereto in a continuous weld seam. This method and fitment work best when the angle of the corner is a right angle and the angle between the roof and the protrusion is a right angle.

In many cases, however, the corner is not a right angle, the protrusion is not at a right angle to the roof, or there is some other irregularity in the protrusion, such as the bottom and the top being different sizes. In these situations, known fitments and methods do not provide satisfactory results. The membrane must be folded or "bunched" in order to conform the membrane to the underlying structure. The folding and bunching is unsightly, and water may collect in the folds which may have deleterious effects on the roofing membrane and/or may lead to localized leaks at seams and at other places in the membrane. In addition, folding can lead to cracking of the roof membrane over time due in part to stress induced by the fold lines. Therefore, a need exists for an adjustable fitment and roof membrane system that provides a smooth transition no matter what the shape or angle of the underlying protrusion and that eliminates the need to fold or bunch the fitment or the roof membrane.

U.S. Pat. No. 5,706,610 provides one embodiment of an adjustable roof membrane which includes a universal fitment and a universal boot. The disclosure of U.S. Pat. No. 5,706,610 is hereby incorporated by reference. In this embodiment, the universal fitment has a body with preferably three sides, a tab, and a neck connecting a corner of the body to the tab. The body is preferably either substantially square or substantially triangular. The patent also discloses an embodiment of a universal boot. The universal boot has a generally rectangular section with a split extending vertically in a side, and it has a fitment with a body having at least three sides, a tab, and a neck connecting a corner of the body to the tab. The tab of the fitment is preferably welded to the back of the rectangular section above the split.

U.S. Pat. No. 6,199,326 provides another embodiment of an adjustable roof membrane which includes a universal fitment. The disclosure of U.S. Pat. No. 6,199,326 is hereby incorporated by reference. In this embodiment, the universal fitment is an adjustable corner fitment for a roof. The adjustable corner fitment is comprised of a top membrane and a bottom membrane. The top membrane has a cutout. The cutout extends from a side of the top membrane. The base membrane portion has a first side, a second side, a third side and a fourth side. The first side is connected to the second side at a first angle greater than 90 degrees, and the third side is connected to the fourth side at a second angle greater than 90 degrees. The base membrane portion is conformed to loop shape such that the first side and the second side underlie portions of the top membrane contiguous to the cutout. The first side of the base membrane may be completely welded to the top membrane prior to installation. However, the second side of the base membrane is adjustable relative to the top membrane prior to installation on the roof. Consequently, an installer is able to adjust the corner fitment to a corner in the field to eliminate unnecessary buckling of the corner fitment or the roof membrane. After adjusting the corner fitment to the corner, the installer may then completely weld the second side of the base membrane to the top membrane.

The present invention provides another embodiment of an adjustable fitment and roof membrane system and a method for making the adjustable fitment and roof membrane system. The fitment may be useful with roof membranes to cover exposed roof areas around a vertical protrusion in a roof. As used herein, a vertical protrusion includes all protrusions that have a vertical component. The fitment may be partially secured to a roof membrane, a boot, and/or a spanning strip prior to being positioned at the corner of a vertical protrusion. Alternatively, the fitment may be positioned independently of the other components at the corner of a vertical protrusion. After the fitment is positioned at the corner of a vertical protrusion, a floating portion of the fitment may be adjusted to fit the corner of the vertical protrusion so that there is minimal or no folding or bunching of the material of the fitment. In this adjusted position, the floating portion of the fitment may be dielectically welded, hot air bonded or otherwise secured to another portion of the fitment, and the fitment may be finally dielectically welded, hot air bonded or otherwise secured to the roof membrane, the boot, and/or the spanning strips.

The prefabricated roofing fitment of the present invention may be made from thermoplastic olefin (TPO), polyvinyl chloride (PVC), or any other suitable material. TPO material is much less expensive than other roof membrane material, but has not been used in the roofing industry in the past because TPO is non-conductive material and therefore, cannot be dielectrically welded. Material such as polyvinyl chloride (PVC) has been commonly used in the roofing industry since it can be easily dielectrically welded. However, PVC is much more expensive than TPO. Accordingly, PVC lends itself to dielectric welding or hot air bonding, while TPO lends itself to hot air bonding. With the hot air bonding apparatus and methods of the present invention a fully TOP fitment is achieved.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

Figure 1:
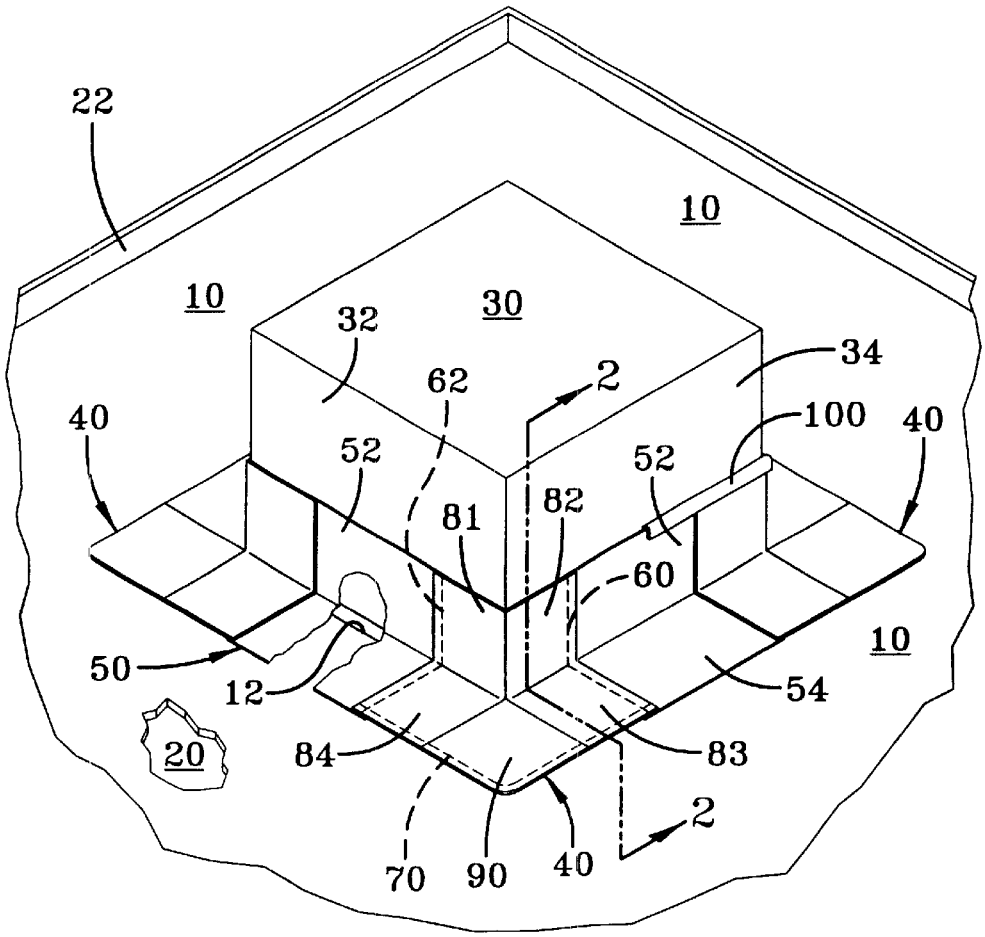
FIG. 1 illustrates a perspective view of an exemplary embodiment of an adjustable roof membrane system of the present invention.
Figure 2:
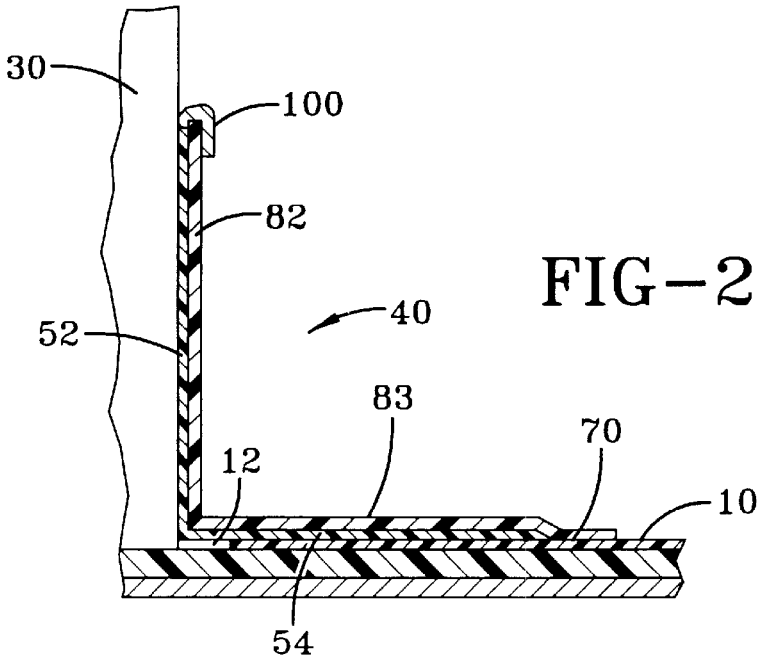
FIG. 2 illustrates a cross sectional view taken on the line 2—2 of FIG. 1.

The present invention is directed to an adjustable corner fitment and roof membrane system and to a method and apparatus for making the adjustable corner fitment preferably using dielectric welding or hot air bonding. Referring primarily to FIGS. 1 and 2, a polymer-membrane 10 is shown overlying a roof 20. The roof 20 may have a surrounding parapet 22. In addition, a protrusion 30 may extend from the roof 20. An opening 12 in the membrane 10 preferably allows the sides 32, 34 of the protrusion 30 to extend through the membrane 10. After the membrane 10 is in place on the roof 20, a preferred embodiment of a fitment 40 of the present invention may be installed to substantially prevent moisture from entering the roof 20 at a corner of the protrusion 30.

In one embodiment of an adjustable roof membrane system of the present invention, fitments 40 may be joined by spanning strips 50 as shown in FIG. 1. Each spanning strip 50 preferably has an upper portion 52 and a bottom portion 54. The bottom portion 54 may be dielectrically welded, hot air bonded or otherwise sealed along its length to the membrane 10, and the fitments 40 may be dielectrically welded, hot air bonded or otherwise sealed to the membrane 10 and the spanning strips 50 as shown at 60, 62, and 70. Although not shown in the figures, it should also be recognized that the fitments 40 may be positioned at the corners of a vertical protrusion such that they are overlapped by the spanning strips 50.

Figure 4:
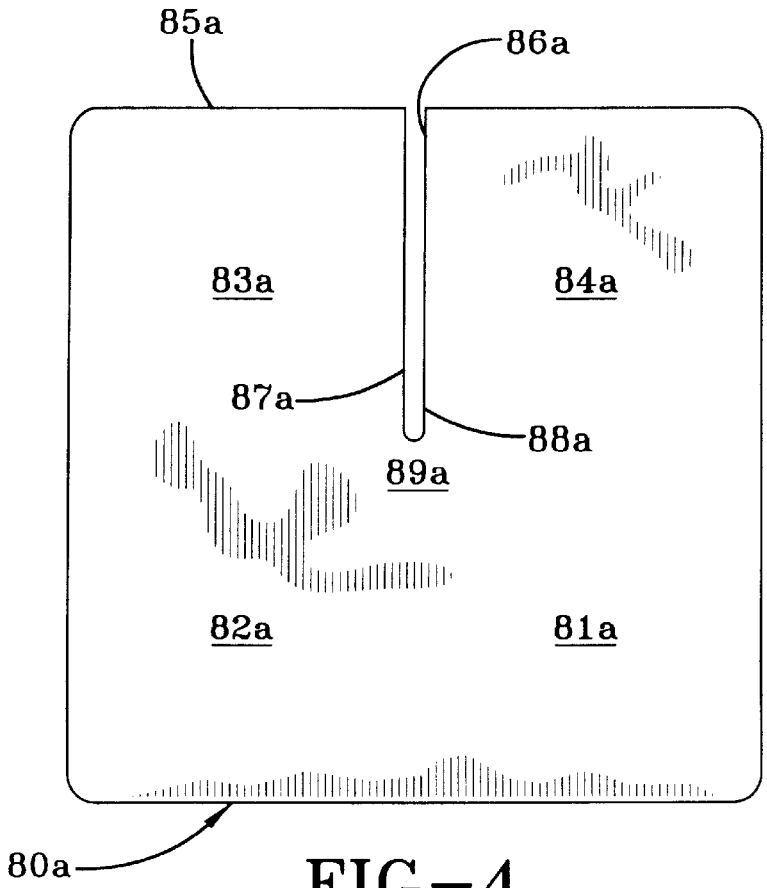
FIG. 4 illustrates a top plan view of an exemplary embodiment of a top membrane portion of a fitment of the present invention.
Figure 5:
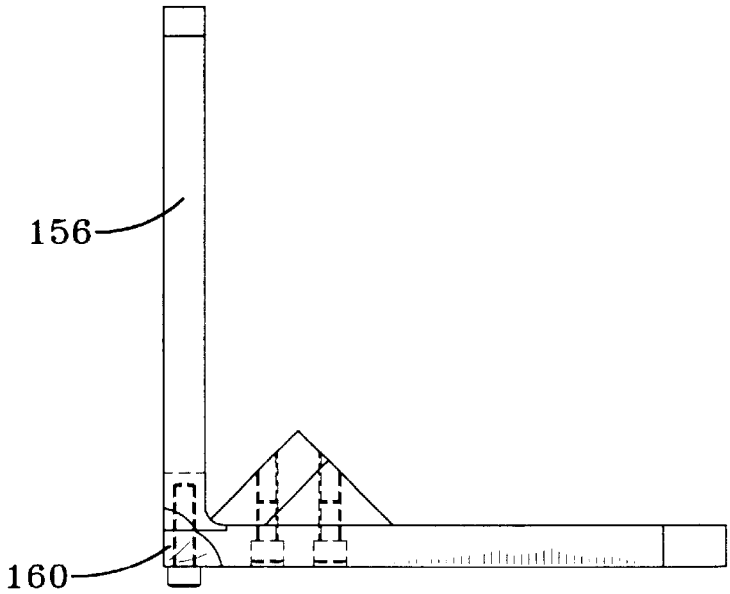
FIG. 5 illustrates a top plan view of an exemplary embodiment of a die used in the method of making a fitment of the present invention.

A fitment 40 preferably has a top membrane portion 80 and a base membrane portion 90. As illustrated in FIG. 4, the top membrane portion 80 is preferably substantially rectangular and may be comprised of quadrants 81, 82, 83, and 84. The top membrane portion 80 has a cutout 86. The cutout 86 preferably divides quadrant 83 from quadrant 84, and it preferably extends from about the middle of side 85 to about the center portion 89 of the top membrane portion 80. As shown in FIG. 4, the cutout 86 may have substantially parallel sides 87, 88. For one example of the cutout 86, the sides 87, 88 may be separated by about one-half inch. However, the cutout 86 may increase in width as the cutout 86 extends from the center portion 89 towards the side 85.

In addition to the embodiment shown in FIG. 4, the top membrane portion 80 may take the form of many different shapes. The shape of the top membrane portion 80 may vary depending on the application. For example, the top membrane portion 80 may have a different number of sides, it may have curved sides, or it may have sides of different lengths. For another example, the cutout 86 may extend from a portion of a side other than the middle, it may extend at an angle which is not perpendicular, or it may have a different shape, length, or width.

Referring back to the embodiment of the adjustable roof membrane system shown in FIG. 1, quadrants 81, 82 of the top membrane portions 80 and upper portions 52 of the spanning strips 50 may be secured by an adhesive or other suitable means to the sides 32, 34 of the protrusion 30. A band 100 may be used to join the top edges of quadrants 81, 82 and upper portions 52. In addition, an adhesive, a bead of mastic, a bead of sealant, or any similar material may be used to form a tight seal between the band 100 and the sides 32, 34 of the protrusion 30.

Figure 3A:
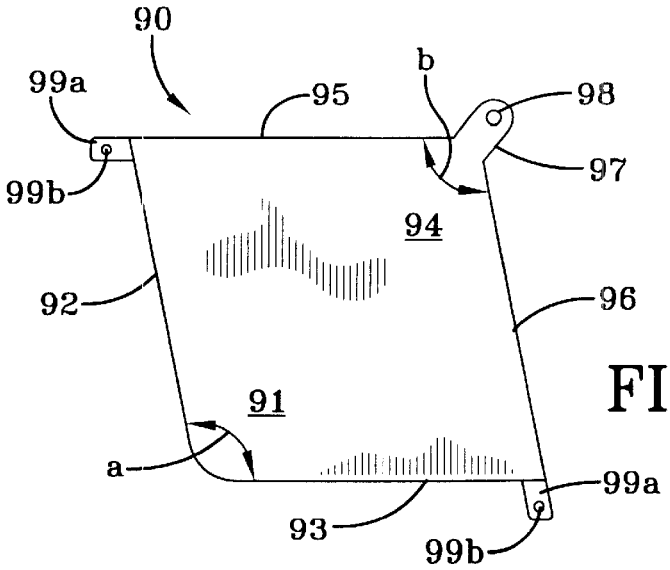
FIG. 3*a* illustrates a top plan view of an exemplary embodiment of a base membrane portion of a fitment of the present invention.

Referring to FIG. 3*a*, the base membrane portion 90 is preferably comprised of a first generally triangular portion 91, a second generally triangular portion 94, and a tab 97 which has a hole 98. Sides 92, 93 of the first generally triangular portion 91 are preferably joined at a radiused corner. In addition, sides 92, 93 extend at an angle a which is greater than about 90 degrees. On the other hand, sides 95, 96 of the second generally triangular portion 94 are connected by the tab 97. The sides 95, 96 extend at an angle b which is greater than about 90 degrees. By making the angles a, b greater than about 90 degrees, the fitment 40 is preferably adjustable. In other words, the angles a, b preferably help to substantially eliminate the need to fold or bunch the fitment 40 when the corner is not a right angle, when the protrusion 30 is not at a right angle to the roof 20, or when there is some other irregularity in the protrusion 30.

However, the blase membrane portion 90 is not limited to the configuration as described above. The base membrane portion 90 may have any other shape that is suitable and may have side tabs 99*a*, which may have a hole 99*b*, on the corner between side 92 and side 95 and/or the corner between side 93 and side 96.

Figure 3B:
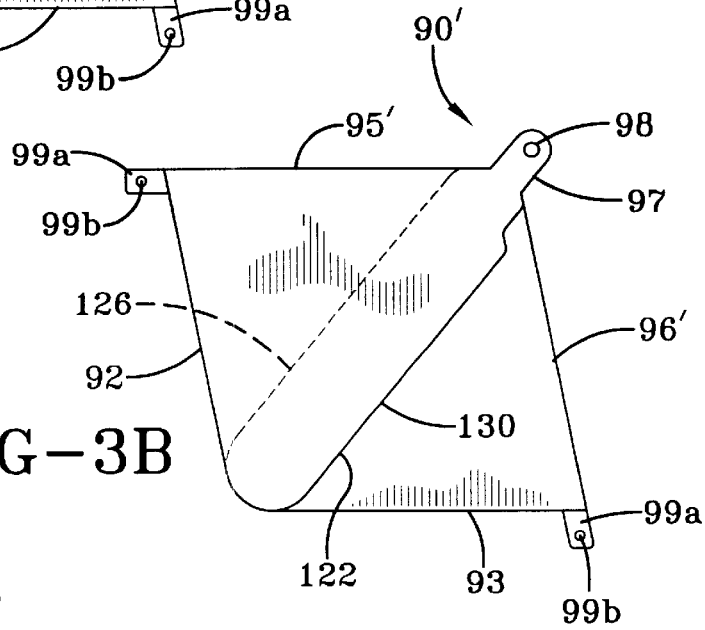
FIG. 3*b* illustrates a top plan view of an exemplary embodiment of a base membrane portion which has a middle adjustment feature.
Figure 3C:
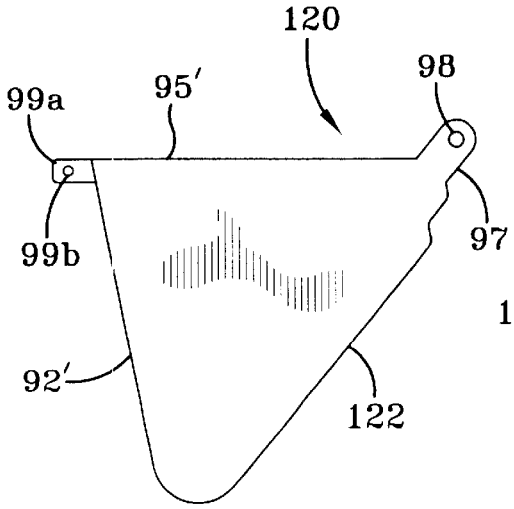
FIGS. 3*c* and 3d illustrate top plan views of an exemplary embodiment of the two components that form the base membrane portion with a middle adjustment feature of FIG. 3*b*.
Figure 3D:
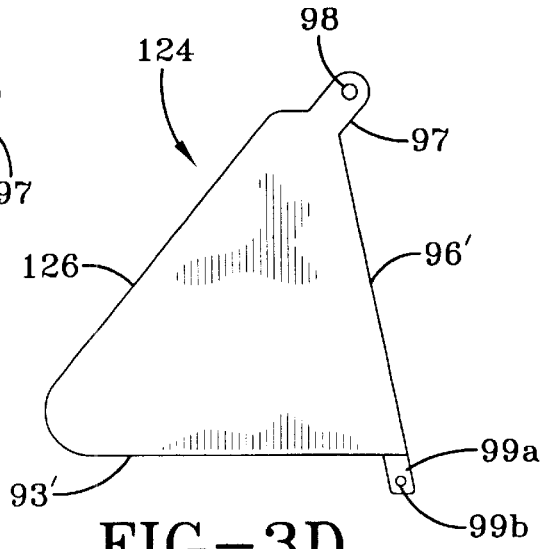

In another exemplary embodiment, the base membrane portion 90' may be comprised of two separate triangular shaped portions 120, 124, as shown in FIGS. 3*b*–3*d*. The first triangular shaped portion 120 may preferably be comprised of three sides 95', 92', 122, a tab 97 which may have a hole 98, and a side' tab 99*a* which may have a hole 99*b*. Side 95' and side 122 are preferably connected by a tab 97, while side 95' and side 92' are preferably connected by a side tab 99*a*. The second triangular shaped portion 124 may preferably be comprised of three sides 96', 93', 126, a tab 97 which may have a hole 98, and a side tab 99*a* which may have a hole 99*b*. Side 96' and side 126 are preferably connected by a tab 97, while side 96' and side 93' are preferably connected by a side tab 99*a*. In an exemplary embodiment, the first triangular shaped portion 120 and the second triangular shaped portion 124 are arranged to form a base membrane portion 90'.

The base membrane portion 90' may be substantially similar to base membrane portion 90. However, base membrane portion 90' has a middle adjustment feature 130 which allows the fitment 40 to be adjusted when sides 95' and 96' are sealed to the top membrane portion 80. The middle adjustment feature 130 is preferably formed by the overlapping of side 122 on the first triangular shaped portion 120 and side 126 on the second triangular shaped portion 124.

Figure 7:
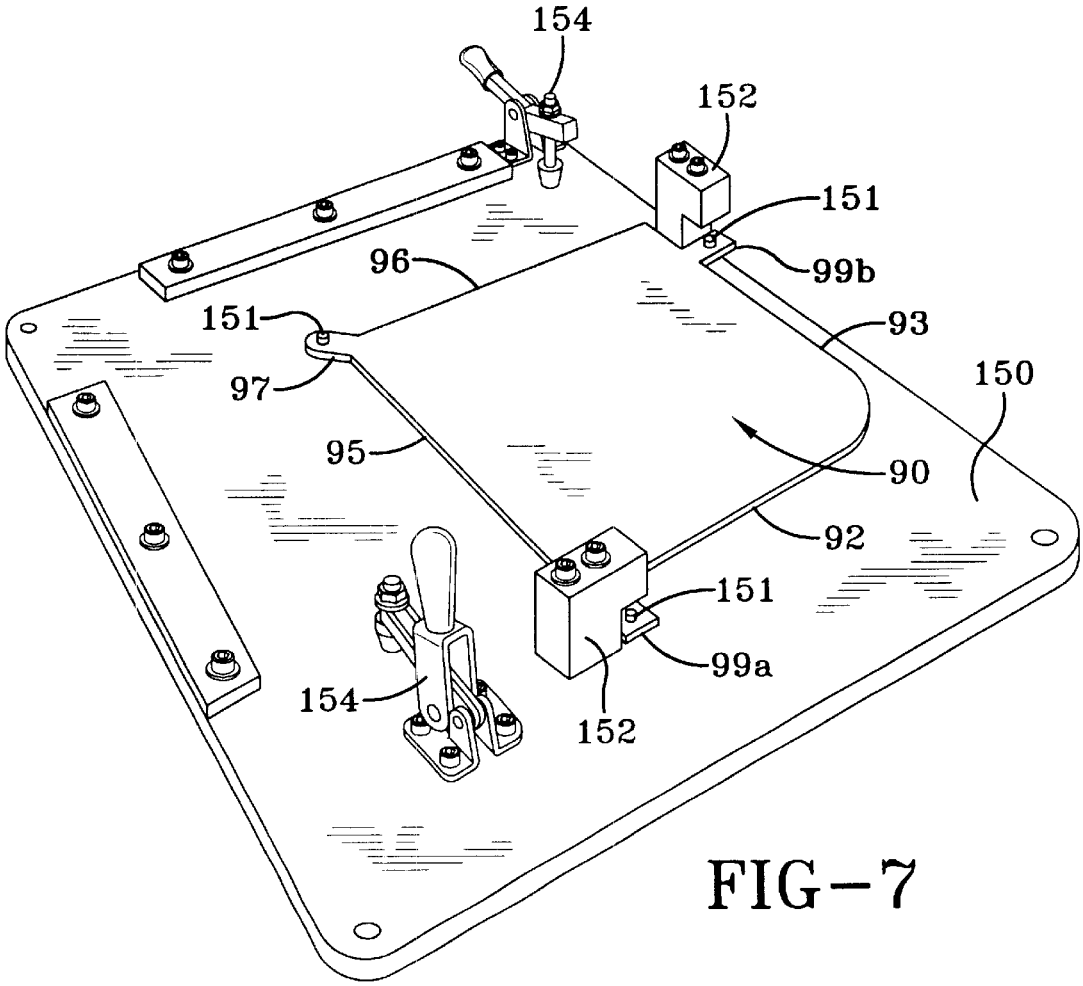
FIG. 7 illustrates a perspective view of an exemplary embodiment of a base membrane portion secured to a base plate.
Figure 8:
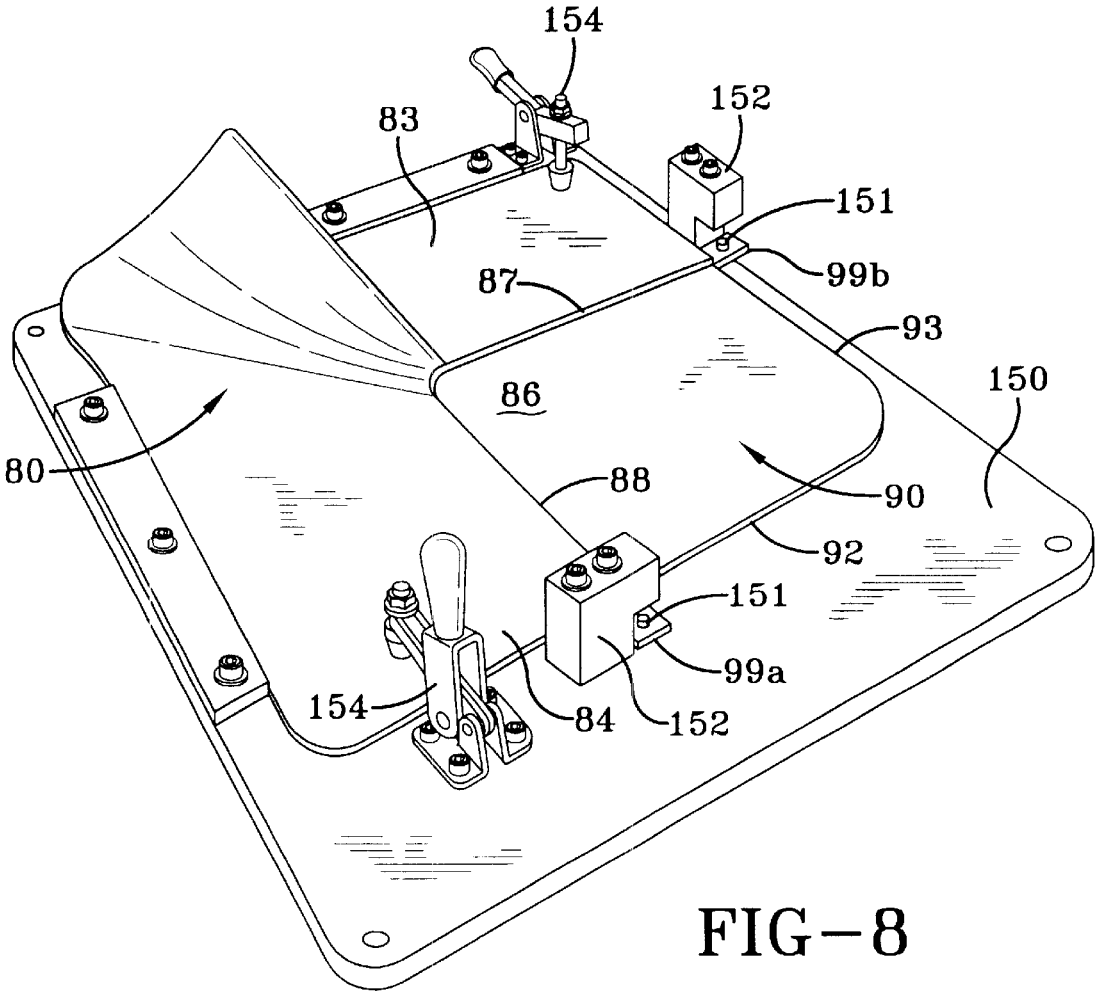
FIG. 8 illustrates a perspective view of an exemplary embodiment of a top membrane portion and a base membrane portion secured to a base plate.

An exemplary method of making a fitment 40 begins by placing the base membrane portion 90 on a base plate 150 so that it is substantially flat, as shown in FIG. 7. The base membrane portion 90 may be held in place by any type of securing device. However, in an exemplary embodiment, the base membrane portion 90 may be held in place on the base plate 150 by placing the holes 98, 99*b*on the tab 97 and the sides tabs 99*a* over the pegs 151 located on the base plate 150. Next, the top membrane portion 80 may be placed over the base membrane portion 90, as shown in FIG. 8. The side 87 of the cutout 86 of the top membrane portion 80 may overlap the side 96 of the base membrane portion 90, while the side 88 of the cutout 86 of the top membrane portion 80 may overlap the side 95 of the base membrane portion 90.

The top membrane portion 80 may be held in place on the base plate 150 by any type of securing device 154. In an exemplary embodiment, the top membrane portion 80 may be held in place by a securing device 154 which may press the quadrant 83 of the top membrane portion 80 against the base plate 150 and another securing device 154 which may press the quadrant 84 of the top membrane portion 80 against the base plate 150, as shown in FIG. 8.

Figure 9:
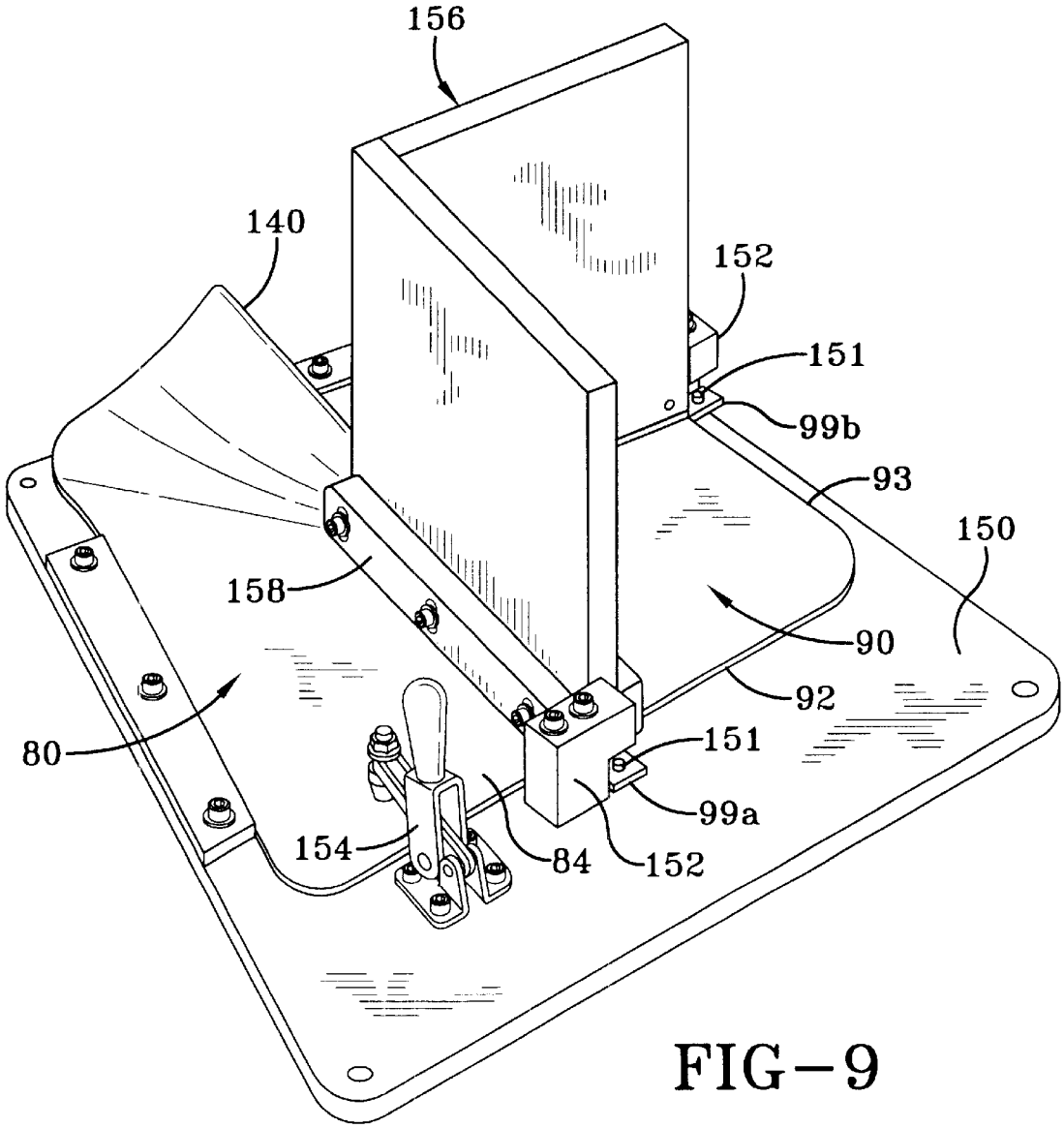
FIG. 9 illustrates a perspective view of an exemplary embodiment of a die positioned on a top membrane portion and a flat base membrane portion.

Once the base membrane portion 90 and the top membrane portion 80 are secured in place on the base plate 150, the portions 80, 90 may be sealed. One exemplary method of sealing portions 80 and 90 may be by dielectric welding. In order to weld, a die 156 may be place on the overlapping portion of the top membrane portion 80 and base membrane portion 90, as shown in FIG. 9. In an exemplary embodiment, the die 156 may be L-shaped. However, the die 156 may have any suitable configuration to conform to the type of seal that is desired. Also, the die 156 may be any width that may accomplish a seal. However, the width of the die 156 may preferably correspond with the width of the seal that is desired.

The die 156 may also contain non-conductive strips 158 on the bottom of the die 156. These non-conductive strips 158 may be made from any material that is not conductive. The non-conductive strips 158 may be in any configuration that will enable the desired seal to be achieved. The non-conductive strips 158 prevent the heat conducted through the die 156 from reaching areas of the base membrane portion 90 or top membrane portion 80 that are not to be sealed, thereby controlling the location of the seal.

Once the die 156 is in place, a heat source may be placed in contact with the die 156. Heat may be transferred from the heat source through the die 156 to the top membrane portion 80 and the base membrane portion 90, thereby forming a weld.

Another exemplary method of sealing the top and base membrane portions 80 and 90 may be by hot air bonding. Once the top membrane portion 80 and the base membrane portion 90 are secured to the base plate 150, as shown in FIG. 8, hot air may be inserted between the edges of the overlapping portions 80, 90. Specifically, hot air may be inserted between overlapping side 88 of the top membrane portion 80 and side 95 of the base membrane portion 90 and/or hot air may be inserted between overlapping side 87 of the top membrane portion 80 and side 96 of the base membrane portion 90, or any other desired configuration.

Figure 12:
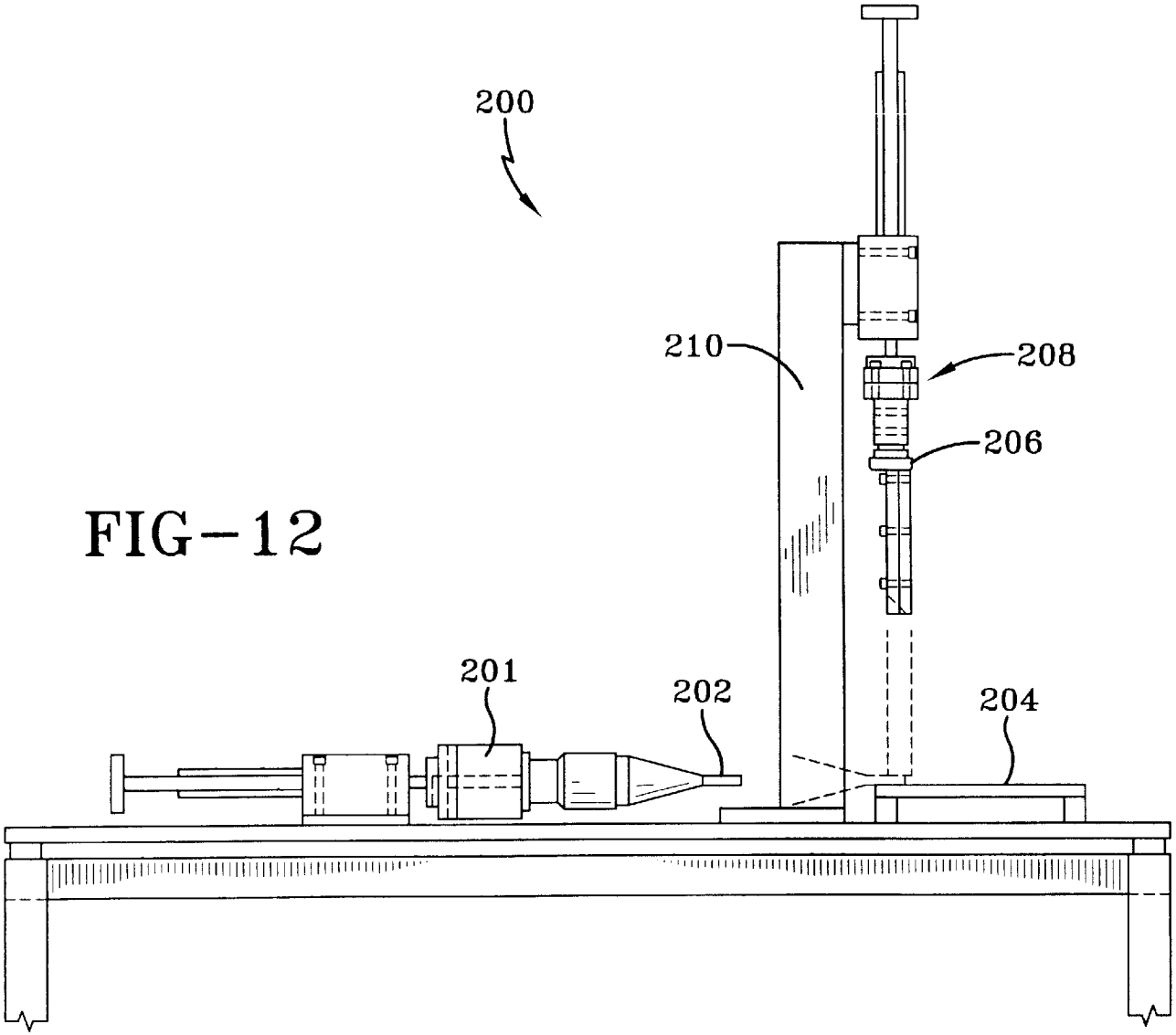
FIG. 12 illustrates a side view of an exemplary embodiment of the apparatus used in hot air bonding the fitment of the present invention.
Figure 13:
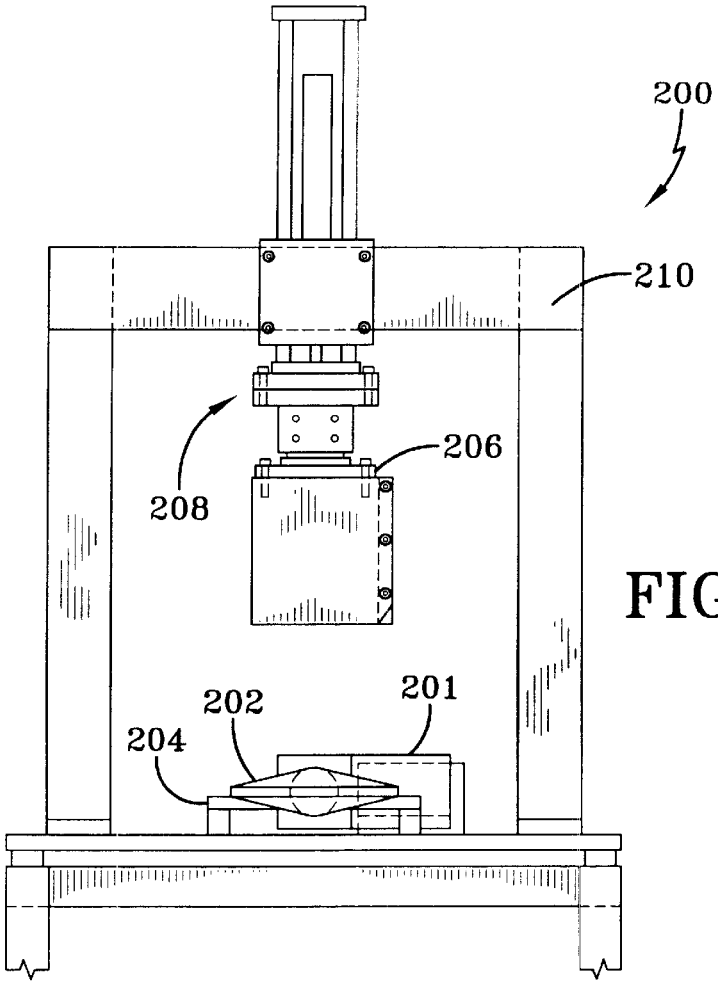
FIG. 13 illustrates an end view of an exemplary embodiment of the apparatus of FIG. 12.
Figure 14:
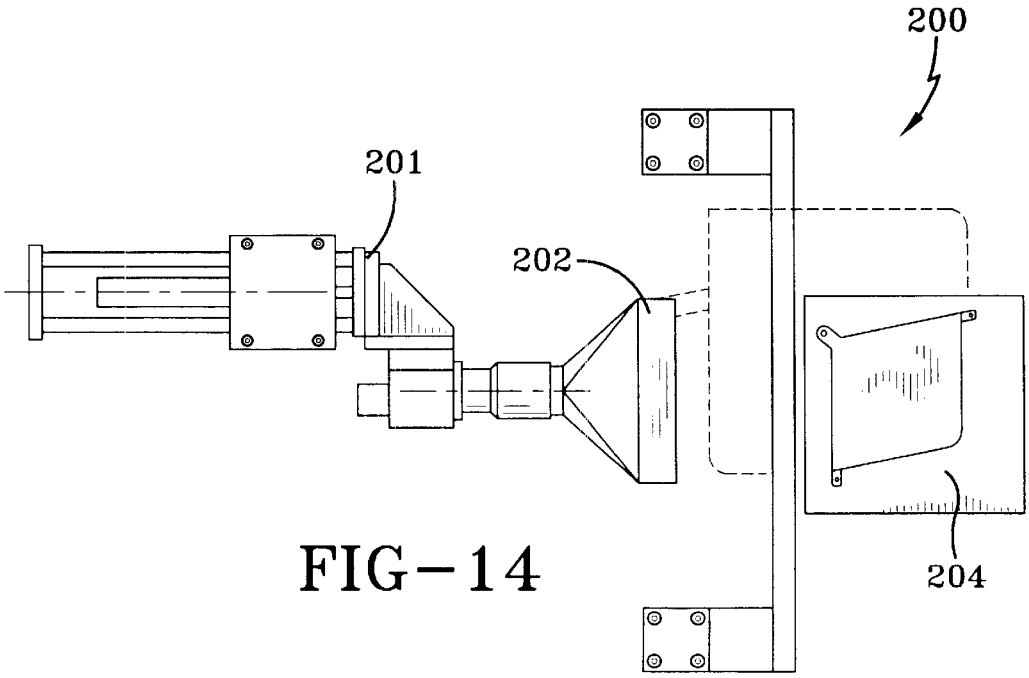
FIG. 14 illustrates a top plan view of an exemplary embodiment of the apparatus of FIG. 12.

The insertion of hot air may be done manually or by any type of suitable apparatus. An exemplary embodiment of an apparatus for inserting the hot air for hot air bonding is shown in FIGS. 12–14. The hot air insertion apparatus 200 may contain a base 204, a heat gun 201 with nozzle 202, a vertical support member 210, and a vertical retractable arm 208 with a connecting element 206. A base membrane portion 90 may be secured to the base 204 so that it is substantially flat, while a top membrane portion 80 may be held in place by the connecting element 206 at the end of the vertical retractable arm 208. The vertical support member 210 holds the vertical retractable arm 208 substantially above the base 204.

Once the base membrane portion 90 is secured on the base 204 and the top membrane portion 80 is secured by the connecting element 206 on the vertical retractable arm 208, the vertical retractable arm 208 may be lowered until the top membrane portion 80 is just above the base membrane portion 90 on the base 204. In an exemplary embodiment, the vertical retractable arm 208 may be lowered so that the top membrane portion 80 is about a half-inch above the base membrane portion 90 on the base 204. Next, the heat gun 201 may extend horizontally toward the base 204 until the nozzle 202 is substantially in between the overlapping portions (sides) of the top membrane portion 80 and the base membrane portion 90. The nozzle 202 emits hot air from the heat gun 201 to the substantially overlapping areas of the top and base membrane portions 80, 90 that are to be bonded together. The nozzle 202 emits hot air for a sufficient amount of time to enable the membrane portions 80, 90 to be bonded together.

After the heat gun 201 emits hot air, via the nozzle 202, for a sufficient amount of time, the heat gun 201 may retract horizontally away from the base 204. Then the connecting element 206 on the vertical retracting arm 208 presses down on the top membrane portion for a determined amount of time then releases the top membrane portion 80 and retract upwards. Next, a die 156 may be placed on the overlapping portion of the top membrane portion 80 and base membrane portion 90, as shown in FIG. 9. The die 156 may remain in place for a sufficient amount of time to allow the membrane portions 80, 90 to be bonded together, thereby forming the fitment 40 of the present invention having a hot air bond.

Figure 11:
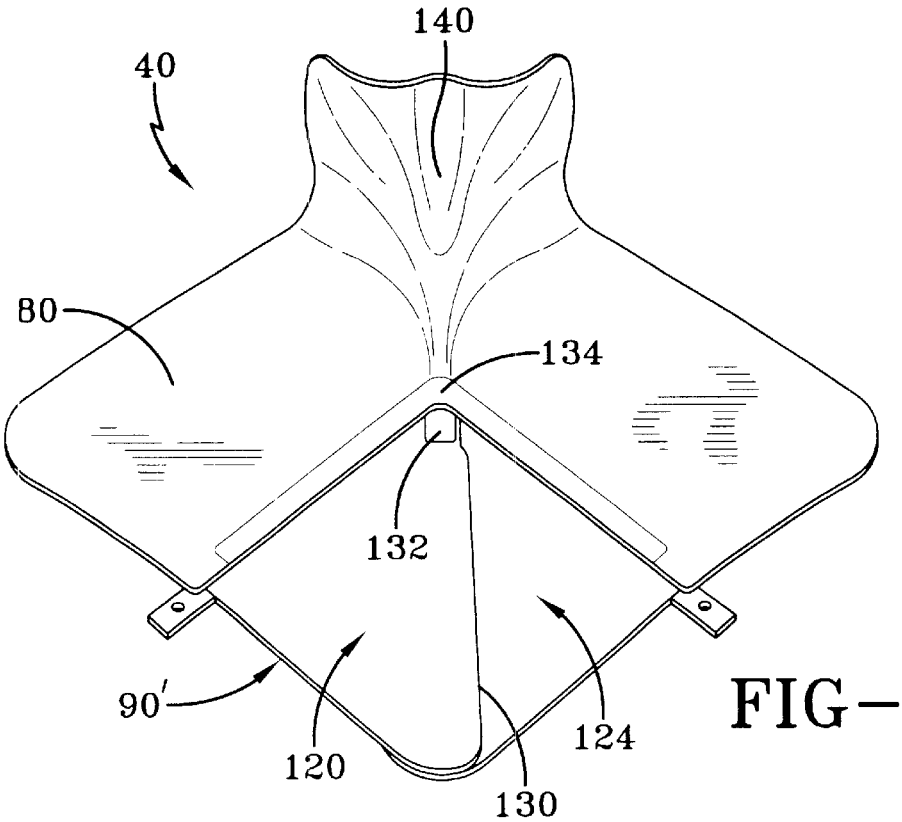
FIG. 11 illustrates a perspective view of an exemplary embodiment of an adjustable corner fitment of the present invention that has a middle adjustment feature.

In another preferred embodiment of the present invention, the fitment 40 may be made according to the methods described above. However, the base membrane portion 90 may be a base membrane portion 90'. This base membrane portion 90' may be comprised of two triangular shaped portions 120, 124. This base membrane portion 90' has a middle adjustment feature 130 which allows the fitment 40 to be adjusted around a protrusion 30 when sides 95' and 96' are sealed to the top membrane portion 80 prior to installation. In an exemplary embodiment, the middle adjustment feature 130 may have a partially sealed portion 132 extending from the radius 134 of the fitment 40. This partially sealed portion 132 is preferably about a half-inch in length, but can be any suitable length. FIG. 11 illustrates a fitment 40 with a middle adjustment feature 130.

Various sizes and shapes of dies 156 may be used to correspond to the type of seal that may be desired. For example, prior to installation, only one side 95, 96 may be completely sealed, only the tab 97 may be completely sealed, or both sides 95, 96 may be completely sealed. If both sides 95, 96 are not completely sealed prior to installation, the unsealed sides 95 and/or 96 may be sealed after installation of the fitment 40.

Figure 6:
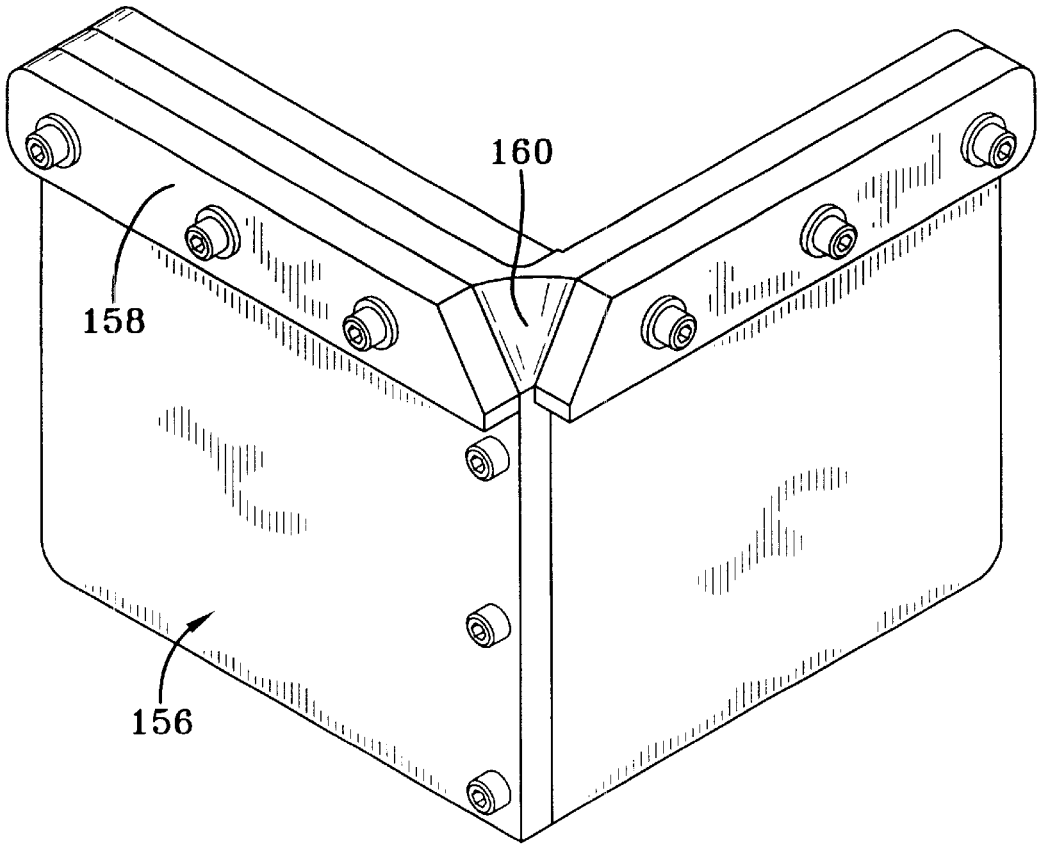
FIG. 6 illustrates a perspective view of an exemplary embodiment of a die used in the method of making a fitment of the present invention.

Additionally, the die 156 that is used to make the present fitment 40 may contain a concave cutout portion 160 on the bottom corner, as shown in FIG. 6. This concave cutout portion 160 forces the pucker at 140 (to the extent a pucker develops) of the top membrane portion 80 to be substantially located in the center of the top membrane portion 80 at the radius 134. This concave cutout portion 160 provides a pucker 140 that is consistently in the same place, i.e., the center of the top membrane portion 80 at the radius 134, as shown in FIGS. 10 and 11 where it will not cause structural integrity problems.

Figure 10:
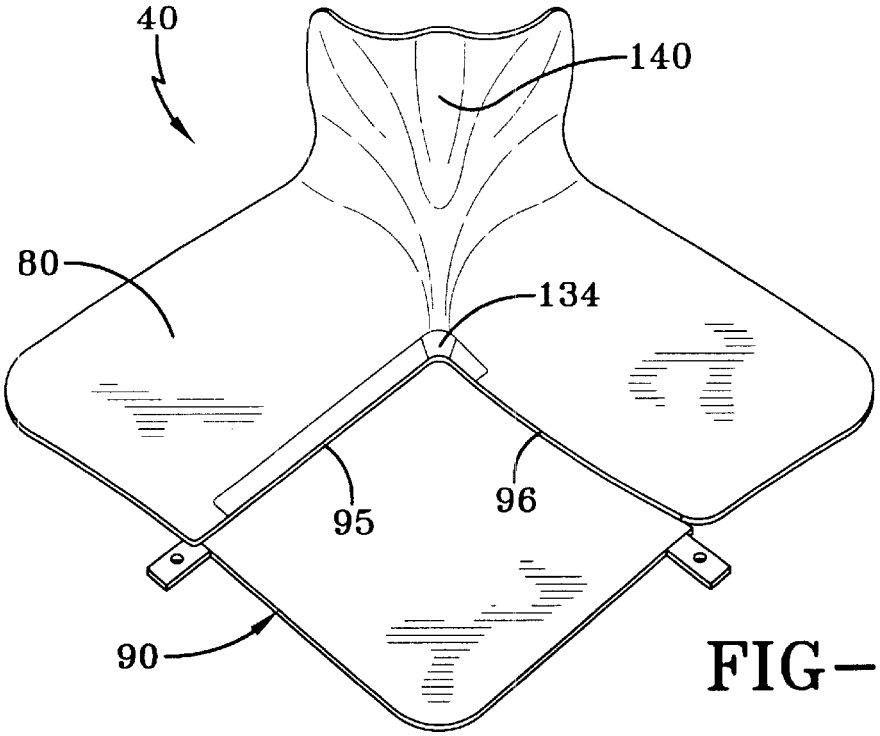
FIG. 10 illustrates a perspective view of an adjustable corner fitment of the present invention that is not completely sealed so that it may be adjusted after positioning and then sealed to conform exactly to a specific protrusion, thereby eliminating "buckling" of the fitment or roofing membrane.

An example of a fitment 40 prior to installation is shown in FIGS. 10 and 11. In an exemplary embodiment, preferably only one of the sides 95, 96 may be completely sealed to the top membrane portion 80 prior to installation on the roof 20. Preferably, only a portion, if any at all, of the other side 95, 96 may be sealed to the top membrane portion 80 prior to installation. This preferably enables the fitment 40 to be adjusted in the field to a corner that is not a right angle, a protrusion 30 that is not at a right angle to a roof 20, and/or an irregularly-shaped protrusion 30. In a fitment 40 that has a middle adjustment feature 130, both sides 95' and 96' are sealed to the top membrane portion 80 prior to installation. However, the middle adjustment feature 130 is not sealed prior to installation and enables the fitment 40 to be adjusted in the field to the corner or protrusion 30 on the roof 20. It should be noted that after sealing, the base membrane portion 90 remains substantially flat.

After the fitment 40 is adjusted to the roof 20 and to the protrusion 30 in the field to substantially eliminate any folding or bunching, the unsealed side 95 and/or 96 may be sealed along its entire length to the top membrane portion 80 or the middle adjustment feature 130 may be sealed.

Those skilled in the art should also recognize that the top membrane portion 80 may be sealed to the base membrane portion 90 prior to installation so that sides 95, 96 may both be adjusted in the field. For one example, the top membrane portion 80 may be sealed only to the tab 97 of the base membrane portion 90 prior to installation. For another example, the top membrane portion 80 may be sealed only to the tab 97 and a limited portion of one or each side 95, 96 of the base membrane portion 90 prior to installation. For another example, the top membrane portion 80 may be sealed to both sides 95', 96' so that the middle adjustment feature 130 may be adjusted in the field.

The die 156 used in forming the fitment 40 of the present invention may be made of various types of material that is suitable to conducting heat. In an exemplary embodiment, the die 156 may be made of various metals, including but not limited to, steel and aluminum. The non-conductive strips 158 on the die 156 may be made of various types of material that is non-conductive such as, but not limited to, rubber.

Other examples of an adjustable roof membrane system of the present invention may also exist. The fitments 40 may be used in conjunction with a universal boot such as the one disclosed in U.S. Pat. No. 5,706,610. The fitments 40 may be adjusted and secured to the corners of the protrusion 30. A boot may be placed around the protrusion 30 and over the fitments 40. The boot may then be sealed to the fitments 40. For another example, a boot may first be placed around and secured to the protrusion 30. The fitments 40 may be placed around the corners of the protrusion 30 such that they overlap the boot. The fitments 40 may then be adjusted and sealed to the boot.

The fitment 40 of the present invention may be made from thermoplastic olefin (TPO), polyvinyl chloride (PVC) and any other suitable material. TPO material is much less expensive than other roof membrane material, but has not been used in the roofing industry in the past because TPO is non-conductive material and therefore, cannot be dielectrically welded. Material such as polyvinyl chloride (PVC) has been commonly used in the roofing industry since it can be easily dielectrically welded. However, PVC is much more expensive than TPO. TPO material may be used to make the present invention because it may be easily and efficiently hot air bonded to form a seal, as described above. Additionally, using TPO material greatly reduces the cost associated with the adjustable fitments and roof membrane system. PVC material may be used to make the present invention because it may easily be dielectrically welded or hot air bonded. Accordingly, PVC and any other suitable material may be used in the method(s) of forming a fitment 40 that use dielectric welding or hot air bonding, while TPO and any other suitable material may be used in the method(s) of forming a fitment 40 that use hot air bonding.

PVC, TPO and other suitable material may be used when the seal of the fitment 40 is formed other than by hot air bonding and dielectric welding, such as by caulking or adhesives.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. An adjustable corner fitment comprising:

a top membrane portion having a cutout, said cutout extending from a side of said top membrane;

a base membrane portion having a first side, a second side, a third side, and a fourth side, said first side extending from said second side at a first angle greater than 90 degrees, said third side extending from said fourth side at a second angle greater than 90 degrees; and wherein said first side of said base membrane portion is sealed to said top membrane prior to installation, said base membrane portion remains substantially flat.

2. The fitment of claim 1, wherein said second side of said base membrane portion is adjustable relative to said top membrane portion prior to installation; and whereby an installer is able to adjust said corner fitment to a corner in the field and then, in a second sealing step, seal said second side of said base membrane portion to said top membrane portion, wherein said base membrane portion remains substantially flat.

3. The fitment of claim 1, wherein said top membrane portion is generally rectangular.

4. The fitment of claim 1, wherein said base membrane portion is generally diamond-shaped.

5. The fitment of claim 1, wherein said cutout has two substantially parallel sides.

6. The fitment of claim 5, wherein said parallel sides of said cutout are separated by about 0.5 inch.

7. The fitment of claim 1, wherein said cutout extends from said side of said top membrane portion, said cutout decreasing in width as it extends from said side of said top membrane portion.

8. The fitment of claim 1, wherein said cutout extends from a middle portion of said side of said top membrane portion.

9. The fitment of claim 1, wherein said first side and said second side of said base membrane portion are connected by a tab.

10. The fitment of claim 1, wherein said second side of said base membrane portion is sealed to said top membrane portion prior to installation.

11. The fitment of claim 1, wherein said seal is a dielectric weld.

12. The fitment of claim 11, wherein said base membrane portion and said top membrane portion are made from polyvinyl chloride (PVC) material.

13. The fitment of claim 1, wherein said seal is a hot air bond.

14. The fitment of claim 13, wherein said base membrane portion and said top membrane portion are made from thermoplastic olefin (TPO) material.

15. The fitment of claim 13, wherein said base membrane portion and said top membrane portion are made from polyvinyl chloride (PVC) material.

16. An adjustable corner fitment comprising:

a top membrane portion having a cutout, said cutout extending from a side of said top membrane;

a base membrane portion having a first side, a second side, a third side, a fourth side, and a tab, said first side extending from said second side by said tab at a first angle greater than 90 degrees, said third side extending from said fourth side at a second angle greater than 90 degrees; and wherein said tab of said base membrane portion is sealed to said top membrane portion prior to installation.

17. The fitment of claim 16, wherein said first side and said second side of said base membrane portion are adjustable relative to said top membrane portion prior to installation; and whereby an installer is able to adjust said corner fitment to a corner in the field and then, in a second sealing step, seal said first side and said second side of said base membrane portion to said top membrane portion, said base membrane portion remains substantially flat.

18. The fitment of claim 16, wherein said first side and said second side of said base membrane portion are sealed to said top membrane portion prior to installation, said base membrane portion remains substantially flat.

19. The fitment of claim 18, wherein said base membrane portion has a middle adjustment feature, said middle adjustment feature is relatively adjustable to allow said fitment to be adjustable when said first side and said second side of said base membrane portion are sealed to said top membrane portion.

20. The fitment of claim 18, wherein said seal is a dielectric weld.

21. The fitment of claim 20, wherein said base membrane portion and said top membrane portion are made from polyvinyl chloride (PVC) material.

22. The fitment of claim 18, wherein said seal is a hot air bond.

23. The fitment of claim 22, wherein said base membrane portion and said top membrane portion are made from polyvinyl chloride (PVC) material.

24. The fitment of claim 22, wherein said base membrane portion and said top membrane portion are made from thermoplastic olefin (TPO) material.

25. The fitment of claim 16, wherein said top membrane portion is generally rectangular.

26. The fitment of claim 16, wherein said base membrane portion is generally diamond-shaped.

27. The fitment of claim 16, wherein said cutout has two substantially parallel sides.

28. The fitment of claim 27, wherein said parallel sides of said cutout are separated by about 0.5 inch.

29. The fitment of claim 16, wherein said cutout extends from said side of said top membrane portion, said cutout decreasing in width as it extends from said side of said top membrane portion.

30. The fitment of claim 16, wherein said cutout extends from a middle portion of said side of said top membrane portion.

31. An adjustable corner fitment comprising:

a top membrane portion having a cutout, said cutout extending from a side of said top membrane portion;

a base membrane portion; and wherein said base membrane portion is at least partially sealed to said top membrane portion prior to installation, said base membrane portion remains substantially flat.

32. The fitment of claim 31, wherein an unsealed portion of said base membrane portion is adjustable relative to said top membrane portion prior to installation; and whereby an installer is able to adjust said corner fitment relative to a corner in the field and then, in a second sealing step, seal said unsealed portion of said base membrane portion to said top membrane portion, wherein said base membrane portion remains substantially flat.

33. The fitment of claim 31, wherein said cutout has two substantially parallel sides.

34. The fitment of claim 31, wherein said cutout extends from said side of said top membrane portion, said cutout decreasing in width as it extends from said side of said top membrane portion towards an inner area of said top membrane portion.

35. The fitment of claim 31, wherein said cutout extends from a middle portion of said side of said top membrane portion.

36. The fitment of claim 31, wherein said seal is a dielectric weld.

37. The fitment of claim 36, wherein said base membrane portion and said top membrane portion are made from polyvinyl chloride (PVC) material.

38. The fitment of claim 31, wherein said seal is a hot air bond.

39. The fitment of claim 38, wherein said base membrane portion and said top membrane portion are made from thermoplastic olefin (TPO) material.

40. The fitment of claim 38, wherein said base membrane portion and said top membrane portion are made from polyvinyl chloride (PVC) material.

* * * * *

UNITED STATES PATENT AND TRADEMARK OFFICE

CERTIFICATE OF CORRECTION

PATENT NO. : 6,754,993 B1 
DATED : June 29, 2004
INVENTOR(S) : Stephen R. Mayle and Robert L. Mayle It is certified that error appears in the above-identified patent and that said Letters Patent is hereby corrected as shown below:

Column 4,
Line 62, please "the blase membrane" and insert -- the base membrane --.

Column 5,
Line 6, please delete "a side' tab" and insert -- a side tab --.
Line 32, please delete "99bon" and insert -- 99b on --.

Signed and Sealed this

Seventh Day of September, 2004

JON W. DUDAS
*Director of the United States Patent and Trademark Office*